United States Patent [19]

Rowe

[11] Patent Number: 4,910,391

[45] Date of Patent: Mar. 20, 1990

[54] ELECTRICAL HEATING ELEMENT FOR USE IN A PERSONAL COMFORT DEVICE

[76] Inventor: William M. Rowe, P.O. Box 682, De Kalb, Miss. 39328

[21] Appl. No.: 237,728

[22] Filed: Aug. 29, 1988

[51] Int. Cl.[4] ..... H05B 3/02; H05B 3/54

[52] U.S. Cl. ..... 219/549; 219/548; 219/505; 219/528; 174/36; 338/210

[58] Field of Search ..... 219/549, 548, 504, 505; 174/36; 338/210, 212, 214

[56] References Cited

U.S. PATENT DOCUMENTS 3,896,261 7/1975 Cole ..... 174/36

4,575,620 3/1986 Ishii ..... 219/505

*Primary Examiner*—Bruce A. Reynolds

*Assistant Examiner*—Leon K. Fuller

*Attorney, Agent, or Firm*—George A. Bode

[57] ABSTRACT

An electrical resistance heating element protected against being inimical to the health of a person using the element by enclosing the electromagnetic and electrostatic fields of an electrical current flowing through an electrical heating element providing essentially all of the heat for the element.

16 Claims, 3 Drawing Sheets

CONNECTION OF RESISTANCE TYPE WIRE

CONNECTION OF PTC TYPE WIRE

ELECTRICAL HEATING ELEMENT FOR USE IN A PERSONAL COMFORT DEVICE

BACKGROUND OF THE INVENTION

1. Field of the Invention

The present invention relates to an electrical heating apparatus and more particularly to an electrical heating apparatus in which the electromagnetic fields and electrostatic fields associated with personal heating devices having positive temperature coefficient bodies are reduced to protect the user against health hazards associated with electromagnetic fields and electrostatic fields.

2. General Background

Electrically heated personal comfort, or medical aid, devices typically include an electrical resistance heating body threaded between a pair of fabric covers. Heat is generated and supplied to the user when electrical energy is applied across a heater wire which is woven with pockets or slots into which the resistance heating body is threaded. Conventionally, the temperature of the personal comfort device is controlled by a suitable controller connected to the resistance heating body.

An improvement to the personal comfort heating device is characterized by a heating portion of positive temperature coefficient, hereinafter termed PTC, material which is included in the resistance heating body. For examples of such devices see U.S. Pat. No. 3,410,984 issued to Sandford et al.; and, U.S. Pat. Nos. 4,271,350, 4,309,596 and 4,309,597 issued to Crowley.

However, the basic material from which the PTC heating portion is formed may be subject to conductor breakage. Sopory in U.S. Pat. No. 4,334,351 discloses extruding a second polymeric PTC material having great flexibility over an underlying PTC composition which is relatively rigid in order to prevent damage to the heating body from flexing, and, prevent conductor breakage. Ishii et al. discloses in U.S. Pat. No. 4,575,620 a heating portion having a positive temperature coefficient which is held in electrical contact with at least one of a first and second conductive bodies and a third conductive body acting as a fusing wire in the event of fracture of the PTC portion. Mills discloses in U.S. Pat. No. 4,577,094 a sensing wire and circuit to shut down a conventional blanket in the event of overheating. Thus, until the present invention, prior patents have been directed toward the personal safety of the user against an overheating failure which are commonly known to cause fires.

However, it has now been found that a more serious danger than that caused by overheating exists. Data as disclosed by D. Carpenter, "Report to the Fourth Annual EEPA Meeting", Bioelectromagnetics Society Newsletter, June 1988, and "Biological Effects of Power Line Fields" Panel's Final Report, New York State Power Lines Project, July 1987, which are incorporated herein, has been found to indicate that electromagnetic fields, and electrostatic fields contribute to tumor growth. Studies as disclosed by B. W. Wilson et al., "Domestic ELF Field Exposure and Peneal Gland Function", Tenth Annual Meeting Abstracts, BEMS, June 1988, which is incorporated herein, have definitely shown a correlation between malfunction of certain portions of the human endocrine system in the presence of conventional personal heating devices having positive temperature coefficient bodies. H. K. Florig et al. discloses in "Electric Field Exposure From Electric Blankets", IEEE Transactions on Power Delivery, April 1987, which is incorporated herein, that significant electric fields are present under electric blankets when heating.

SUMMARY OF THE PRESENT INVENTION

Accordingly, it is an object of the present invention to provide an improved electrical heating element for use in a personal comfort heating device of the type in which the electromagnetic fields and electrostatic fields associated with the electrical heating element of the personal heating devices are reduced to protect the user against health hazards associated with electromagnetic fields and electrostatic fields.

In accordance with this object, it is a further object of the present invention to provide an improved electrical heating element for use in a personal comfort heating device of the type in which the electromagnetic fields and electrostatic fields associated with an electrical heating element having a positive temperature coefficient portion thereof are reduced to protect the user against health hazards associated with electromagnetic fields and electrostatic fields.

In particular, the electrical heating element of the present invention includes a means for enclosing the electromagnetic and electrostatic fields of an electrical current flowing through the electrical heating means so that the electromagnetic fields and electrostatic fields are reduced.

The above objects and other features of the present invention will become apparent from the drawings, the description given herein, and the appended claims.

BRIEF DESCRIPTION OF THE DRAWING

For a further understanding of the nature and objects of the present invention, reference should be had to the following description, taken in conjunction with the accompanying drawings, in which like parts are given like reference numerals and, wherein.

DETAILED DESCRIPTION OF THE PREFERRED EMBODIMENT

Figure 3:
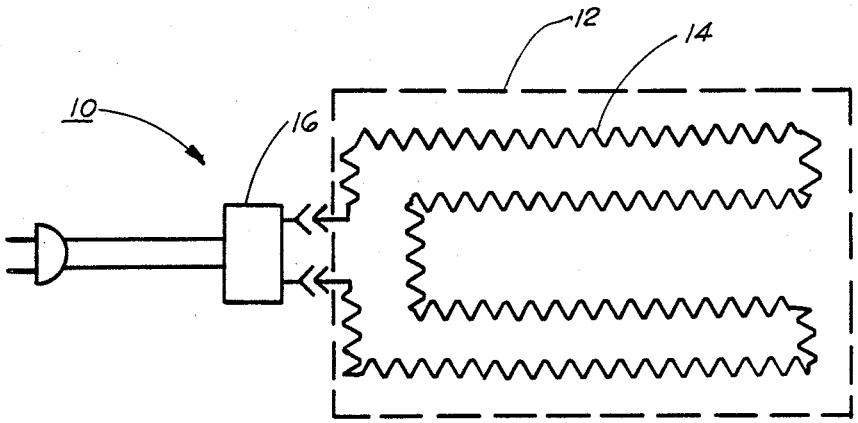
PRIOR ART FIG. 3
FIG. 3 is a schematic representation of a first conventional arrangement for interconnecting the prior resistance heating bodies of FIGS. 1 and 2.
Figure 4:
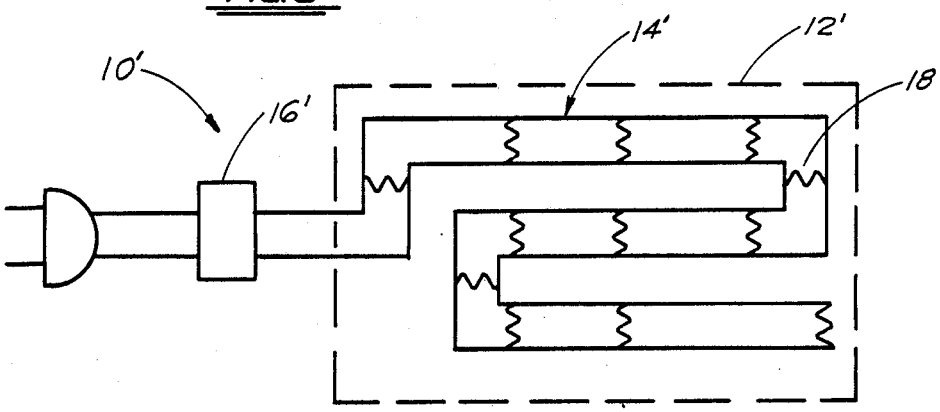
PRIOR ART FIG. 4
FIG. 4 is a schematic representation of a second conventional arrangement for interconnecting the prior resistance heating bodies of FIGS. 1 and 2.
Figure 2:
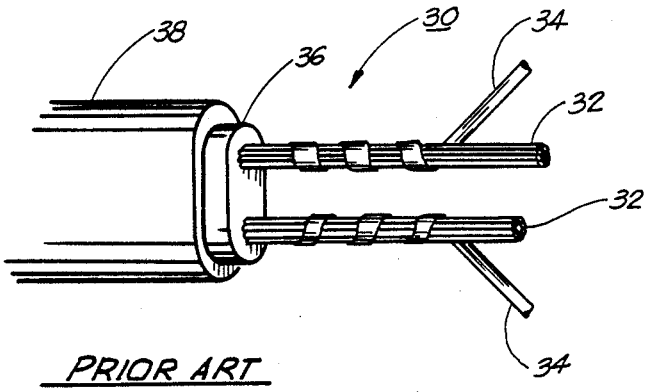
PRIOR ART FIG. 2
FIG. 2 is a cut away side view of a second prior resistance heating body.

Referring to FIGS. 3 and 4, schematics of a conventional personal comfort device represented by reference numerals 10 and 10', such as an electric blanket, shows a conventional personal comfort device as having an envelope as indicated by reference numerals 12 and 12', and electrical resistance heating elongated body as indicated by reference numerals 14 and 14' and a suitable controller indicated by reference numerals 16 and 16' connected to resistance heating body 14, 14'. Envelope or fabric cover 12, 12' is woven with unshown pockets, or slots, into which heating body 14, 14' is shuttled. Referring specifically to FIG. 2, a schematic representation of a personal comfort device 10' having an electrical resistance heating body 14' that includes a PTC heating portion is shown. The representation as indicated by reference numeral 18 indicates that a personal comfort device having an electrical resistance heating body that includes a PTC heating portion are essentially parallel heating devices in which the plastic PTC material is the heater. Included with the personal comfort device is its controller 16'.

Figure 1:
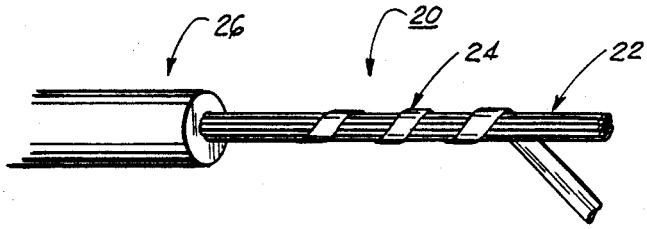
PRIOR ART FIG. 1
FIG. 1 is a cut away side view of a first prior resistance heating body.

FIG. 1 illustrates a prior resistance heating body 20 for use in a conventional personal heating device such as represented by schematic FIGS. 3 and 4. Body 20 includes a fabric core 22 having a plurality of parallel fabric strands, a resistance wire 24 which winds around or spirals about fabric core 22, and a jacket 26 which surrounds core 22 and wire 24. Conventionally, the fabric strands may be of rayon, although dacron, cotton, or any other flexible fibrous nonconductive material may also be used, and jacket 26 in which core 22 and wire 24 are concentrically disposed is typically of polyvinyl chloride, with jacket 26 being extruded over core 22 and wire 24 so that jacket 26 is in electrical contact with wire 24. Typically, wire 24 is copper or cadmium copper resistance wire.

FIG. 2, illustrates a second prior resistance heating body 30 for use in a conventional personal heating device such as represented by schematic FIGS. 3 and 4. Body 30 includes a pair or parallel but spaced fabric cores 32, and a copper wire 34 is wrapped over each fabric core 32. Typically, cores 32 are polyethylene terphthalate where crosslinking is accomplised by electron beam irradiation, with each copper wire 34 and core 32 forming a conductive assembly. The fabric core material of core 32 may be manufactured of rayon, or other fibers, when chemical crosslinking is used. PTC material is extruded over the spaced core and wire assembly to form a jacket 36, and a covering 38 is extruded over the PTC material.

Measurements made on the electromagnetic fields produced by electric blankets manufactured to the schematics of FIGS. 3 and 4, using both conventional non PTC material and PTC material as a jacket have been made, and the results are shown in Table 1 below, along with results from the present invention which is discussed in detail hereafter.

TABLE 1

ELECTROMAGNETIC FIELDS PRODUCED BY ELECTRIC BLANKETS

Figure 6:
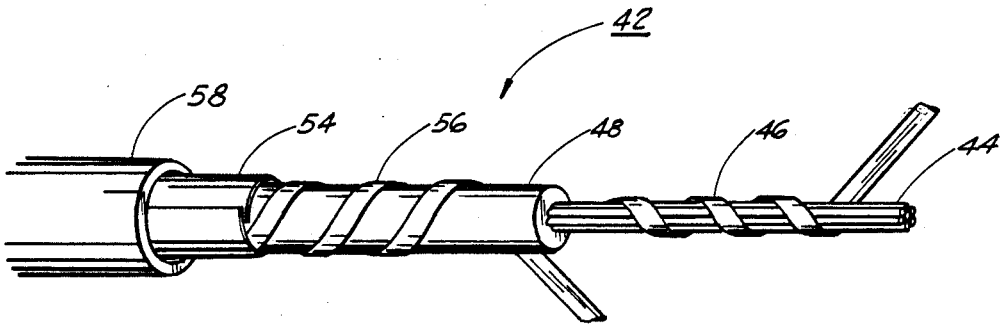
FIG. 6 is a cut away side view of a second embodiment of the resistance electrical heating element according to the present invention.

| Blanket Type | Electromagnetic Field (milligauss) |
|---|---|
| Conventional Resistance | 100 mg to 130 mg on blanket surface |
| PTC type blanket | 120 mg to 150 mg on blanket surface |
| PTC blanket parallel connected | 3 mg to 36 mg on blanket surface |
| Blanket using wire on FIG. 6 connected as shown in | not detectable |

TABLE 1-continued

ELECTROMAGNETIC FIELDS PRODUCED BY ELECTRIC BLANKETS

Figure 8:
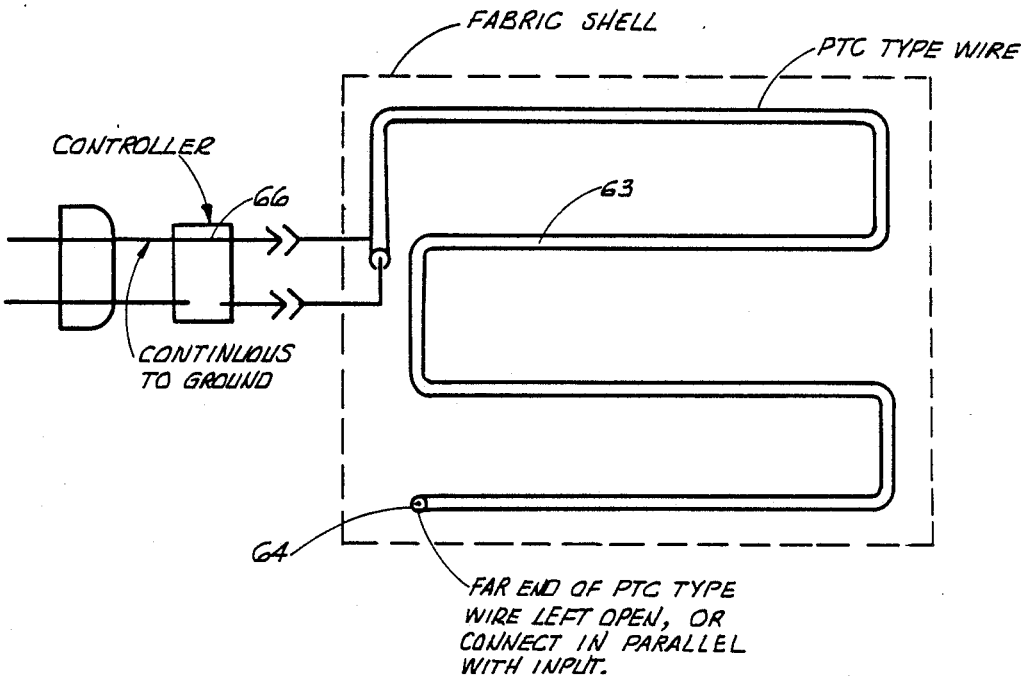

| Blanket Type | Electromagnetic Field (milligauss) |
|---|---|
| FIG. 8 | |

Figure 5:
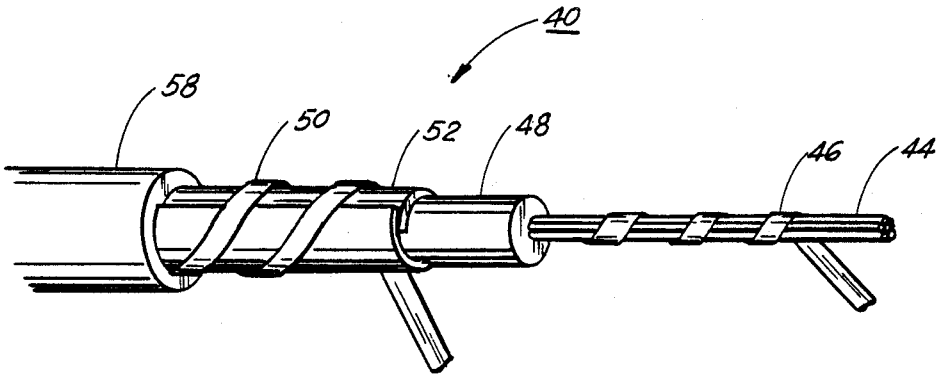
FIG. 5 is a cut away side view of a first embodiment of the resistance electrical heating element according to the present invention.

Referring to FIGS. 5 and 6, the preferred embodiments of the present invention are shown. The present invention is unique in that the present invention addresses a new and distinct form of personal hazard, which indicates that electromagnetic fields, and electrostatic fields contribute to tumor growth. Studies have shown a correlation between malfunction of certain portions of the human endocrine system in the presence of prior personal heating devices having positive temperature coefficient bodies, and it has been shown that significant electric fields are present under electric blankets when heating.

Referring to FIGS. 5 and 6, the preferred embodiments of the electrical heating element shown generally as 40 and 42, and referred to as the first and second embodiments, are shown. Conventionally, electrical heating element 40, 42 includes an electrical heating means for generating heat in proportion to an amount of electrical current flowing therethrough. The heating means includes a fabric core 44 with parallel fabric stands which are similar to core 22 and which provide mechanical strength to heating element 40, 42, a resistance wire 46 similar to wire 24, and a jacket 48. Core 44 may have physical and mechanical characteristics to limit its flexibility, thereby avoiding kinks or bends that might tend to break or knot element 40, 42. Jacket 48 is melt extruded over core 44 and wire 46 so that jacket 48 is in electrical contact with wire 46. As jacket 48 is melt extruded over core 44 and wire 46, core 44 and wire 46 are to be concentrically disposed within jacket 48.

Wire 46, a known resistance heater wire such as copper or cadmium copper, is wrapped around the central core 44 in a helix, and provides heat when electrical current flows therethrough. With either the first or second embodiment of the present invention, jacket 48 may be any suitable known positive temperature coefficient polymer, hereinafter termed simply PTC, and any conductive polymer composition may be used, including that disclosed by U.S. Pat. No. 3,410,984 issued to Sandford et al.; U.S. Pat. Nos. 4,271,350, 4,309,596 and 4,309,587 issued to G. C. Crowley; U.S. Pat. No. 4,560,524 issued to J. H. Smuckler; and, U.S. Pat. No. 4,334,351 issued to U. K. Sopory. As disclosed by Sandford et al., the PTC material may be a polyethylene which has dispersed therein electrically conductive particles such as carbon black to provide the desired characteristics in which the resistance of the material increases with increasing temperature. Preferably, the PTC composition is one that can be melt shaped, e.g. by extrusion, and may be substantially free from cross linking when the melt fusion takes place. Once the melt fusion has taken place, the PTC composition can if desired be cross linked, e.g. by irradiation as known to the art. The PTC composition may also be relatively rigid, i.e. has low elongation.

With the second embodiment, jacket 48 may also be a material which is not a PTC material such polyvinyl chloride. Thus, wire 46 should be chosen to provide the correct resistance heat when the electrical current passes through wire 46. Alternatively, with either the first or second embodiment and when jacket 48 is a PTC material, wire 46 should be an electrical conductive material which provides good conduction with joule heating less than twenty (20%) percent of the total heat generated in electrical heating element 40, 42.

Included with the first and second embodiments of the present invention is a means disposed over the electrical heating means for enclosing the electromagnetic and electrostatic fields of the electrical current flowing through wire 46. Thus, the present invention provides an improved personal comfort heating device of the type in which the electromagnetic fields and electrostatic fields associated with personal heating devices are reduced to protect the user against health hazards associated with electromagnetic fields and electrostatic fields.

Referring to the first embodiment of FIG. 5, the means for enclosing the electromagnetic and electrostatic fields includes an elongated drain wire 50 and an electrically conductive foil 52, with conductive foil 52 being disposed between jacket 48 and drain wire 50. A preferred material for conductive foil 52 is aluminum foil being disposed between jacket 48 and drain wire 50. Drain wire 50 is helically wrapped approximately five turns per inch or more, up to, but not restricted to 20 turns per inch over foil 52 in an electrically contacting engagement with foil 52 over the longitudinal length of drain wire 50. Wire 50 may be copper, cadmium copper or any other suitable conductive material. Advantageously, with this embodiment, conductive foil 52 may be applied when jacket 48 is melt extruded over core 44 and wire 46. Thus, by applying conductive foil 52 at extrusion, the heat of extrusion will cause foil 52 to bond to jacket 48. Hence, conduction is obtained to conductive foil 52.

Referring to the second embodiment of FIG. 6, the means for enclosing the electromagnetic and electrostatic fields includes an electrically conductive foil 54 and an elongated drain wire 56, with drain wire 56 being disposed between jacket 48 and foil 54. Conductive foil 54 is similar to conductive foil 52, and a preferred material for conductive foil 54 is aluminum foil, due to its low resistance and high conductivity, with drain wire 56 being disposed between jacket 48 and the aluminum foil. Drain wire 56 is helically wrapped approximately 5 turns per inch or more, up to, but not restricted to, 20 turns per inch around jacket 48 in an electrically contacting engagement with jacket 48 over the longitudinal length of drain wire 56. Wire 56 may be copper, cadmium copper or any other suitable conductive material. Following the wrapping of drain wire 56 over jacket 48, a covering of conductive foil 54 is placed over drain wire 56 so that wire 56 lies under foil 54 and between foil 54 and jacket 48, and is in electrical contact with drain wire 56 and jacket 48. Foil 54 can be tape wrapped or cigarette wrapped around wire 56 and jacket 48 by techniques known to the art. Accordingly, this embodiment is to be preferred if conductive foil 54 is to be applied as the final step, rather than with the heat extrusion step of the first embodiment.

An electrically insulating final covering 58 which may be polyvinyl chloride is extruded over conductive foil 54 of FIG. 6 and over drain wire 50 and conductive foil 52 of FIG. 5 to protect the user from possible electrical shocks due to breakage and to protect the embodiments from physical damage.

Figure 7:
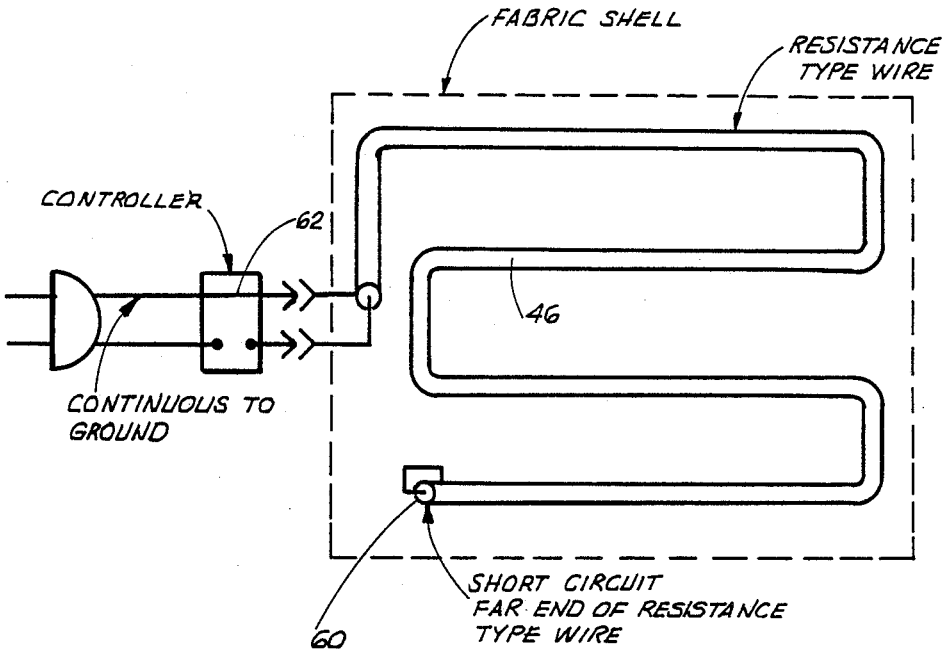
FIG. 7 is a schematic representation of a first method according to the present invention of interconnecting the present invention of the resistance electrical heating element of FIGS. 5 and 6; and, FIG. 8 is a schematic representation of a second method according to the present invention of interconnecting the present invention of the resistance electrical heating element of FIGS. 5 and 6.

The present invention includes the applications of FIGS. 7 and 8. Thus, when electrical heating element 40 or 42 is interconnected in such a manner as shown in FIGS. 7 and 8, the benefits of the invention are obtained. Referring to FIG. 7, an embodiment of electrical heating element 42 which does not have a PTC jacket 48 has its electrically conductive resistance wire 46 short circuited at its free end as indicated by reference numeral 60 to drain wire 46 to provide the advantages of the present invention. Referring to FIG. 8, the embodiments of electrical heating element 42, 44, indicated in the FIGURE by reference numeral 63, which have a PTC jacket 48, have their free end left open as indicated by reference numeral 64, or connected in parallel with the input from controller 66.

Thus, in accordance with the present invention, a personal heating device is obtained which does not produce hazardous electromagnetic or electrostatic fields. Measurements as presented in Table 1 above made on the electromagnetic fields show that an electric blanket manufactured to the schematics of FIG. 8 and using an electrical heating element 42 of FIG. 6 has a non detectable electromagnetic field. Thus, the present invention provides an improved electrical heating element for use in a personal comfort heating device in which the electromagnetic fields and electrostatic fields associated with the electrical heating element are reduced.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An electrical heating element protected against being inimical to the health of a person using the element, comprising:

(a) an electrical heating means for generating heat in proportion to an amount of electrical current flowing therethrough, said heating means providing essentially all of the heat for said element and including a non-conductive core and a conductive resistance portion helically wrapped around said core and a positive temperature conductive polymer surrounding said conductive resistance portions and electrically contacting said conductive resistance portion; and, (b) means disposed over said electrical heating means for enclosing the electromagnetic and electrostatic fields of the electrical current flowing therethrough including an electrically conductive foil portion wrapped over said conductive polymer and electrically contacting said conductive polymer, said electrically conductive foil portion surrounding and enclosing said conductive polymer for enclosing the electromagnetic and electrostatic fields of the electrical current flowing through said conductive resistance portion.

2. The electrical heating element of claim 1, wherein said electrically conductive foil portion is an aluminum foil.

3. The electrical heating element of claim 1, wherein said nonconductive core and said conductive resistance portion are concentrically and coextensively disposed within said conductive polymer.

4. The electrical heating element of claim 3, wherein said means for enclosing the electromagnetic and electrostatic fields includes a drain wire coextensively and helically wrapped over said foil portion, said foil portion separating said conductive polymer and said drain wire.

5. The electrical heating element of claim 3, wherein said means for enclosing the electromagnetic and electrostatic fields includes a drain wire coextensively and helically wrapped over said conductive polymer between said conductive polymer and said foil portion, said drain wire electrically contacting said conductive polymer and said foil portion.

6. The electrical heating element of claim 1, wherein said electrical heating means further comprises a nonconductive polymer supporting and enclosing said conductive resistance portion.

7. The electrical heating element of claim 6, wherein said means for enclosing the electromagnetic and electrostatic fields includes an electrically conductive foil portion wrapped over said nonconductive polymer, said foil portion surrounding and enclosing said conductive polymer for enclosing the electromagnetic and electrostatic fields of the electrical current flowing through said conductive resistance portion.

8. The electrical heating element of claim 7, wherein said electrically conductive foil portion is an aluminum foil.

9. The electrical heating element of claim 7, wherein said nonconductive core and said conductive resistance portion are concentrically and coextensively disposed within said nonconductive polymer.

10. The electrical heating element of claim 9, wherein said means for enclosing the electromagnetic and electrostatic fields includes a drain wire coextensively and helically wrapped over said foil portion.

11. The electrical heating element of claim 7, wherein said means for enclosing the electromagnetic and electrostatic fields includes a drain wire coextensively and helically wrapped over said nonconductive polymer between said nonconductive polymer and said foil portion, said drain wire electrically contacting said foil portion.

12. An electrical heating element protected against being inimical to the health of a person using the element, comprising:

(a) a nonconductive core and a conductive resistance portion helically and coextensively wrapped around said core, said core and said resistance portion providing an electrical heating means for generating heat in proportion to an amount of electrical current flowing through said resistance portion, said resistance portion providing essentially all of the heat for said element;

(b) a positive temperature conductive polymer surrounding said heating means and electrically contacting said resistance portion, said nonconductive core, said conductive resistance portion and said conductive polymer providing said electrical heating means; and, (c) means surrounding said conductive polymer and spaced from and enclosing said resistance portion for enclosing the electromagnetic and electrostatic fields of the electrical current flowing through said resistance portion, said means for enclosing the electromagnetic and electrostatic fields electrically contacting said conductive polymer.

13. The electrical heating element of claim 12, wherein said nonconductive core is dacron.

14. The electrical heating element of claim 12, wherein said means for enclosing the electromagnetic and electrostatic fields is an aluminum foil which includes wrapped around said conductive polymer.

15. A method of manufacturing an electrical heating element, comprising the steps of:

(a) melt extruding a polymer over an elongated conductive resistance portion so that said resistance portion is disposed concentrically and coextensively within said polymer;

(b) placing an electrically conductive wrap around said polymer and enclosing the resistance portion;

(c) helically and coextensively wrapping a conductive wire around said electrically conductive wrap; and, (d) helically and coextensively wrapping a conductive wire around said polymer between said polymer and said electrically conductive wrap.

16. The method of claim 15, wherein the step of placing an electrically conductive wrap around the polymer includes the step of bonding said electrically conductive wrap to said polymer.

* * * * *